US005869223A

United States Patent [19]

Roussilhe

[11] Patent Number: 5,869,223

[45] Date of Patent: Feb. 9, 1999

[54] METHOD FOR REPLENISHING AN ASCORBIC ACID DEVELOPER

[75] Inventor: Jacques Roussilhe, Virey le Grand, France

[73] Assignee: Eastman Kodak Company, Rochester, N.Y.

[21] Appl. No.: 947,420

[22] Filed: Oct. 8, 1997

[30] Foreign Application Priority Data

Oct. 8, 1996 [FR] France ..... 96 12416

[51] Int. Cl.[6] ..... G03C 5/31

[52] U.S. Cl. ..... 430/399; 430/398

[58] Field of Search ..... 430/398, 399

[56] References Cited

U.S. PATENT DOCUMENTS

| | | | |
|---|---|---|---|
| 3,253,920 | 5/1966 | Rees et al. | 430/399 |
| 4,228,234 | 10/1980 | Okutsu et al. | 430/399 |
| 4,606,827 | 8/1986 | Ernstson et al. | 430/399 |
| 4,680,123 | 7/1987 | Wernicke et al. | 430/399 |
| 5,457,214 | 10/1995 | O'Donnell | 549/315 |
| 5,491,048 | 2/1996 | Anderson et al. | 430/399 |

FOREIGN PATENT DOCUMENTS

| | | |
|---|---|---|
| 0 178 539 | 12/1987 | European Pat. Off. . |
| 0 348 532 | 1/1989 | European Pat. Off. . |
| 0 609 940 A1 | 1/1994 | European Pat. Off. . |
| 26 54 708 | 12/1976 | Germany . |
| 91/07698 | 5/1991 | WIPO . |

OTHER PUBLICATIONS

United States application Serial No. 08/915,521 filed on Aug. 1997.

*Primary Examiner*—Hoa Van Le
*Attorney, Agent, or Firm*—J. Lanny Tucker

[57] ABSTRACT

The present invention concerns a method of replenishing an ascorbic acid developer used for developing silver halide photographic products.

The method of the invention comprises the treatment of the developer by means of a resin having a greater selectivity for bromide ions than for carbonate ions and the replenishment of this developer by means of a solution, the concentration of the main components of which is predetermined in accordance with the quantity of developed silver.

This invention simplifies the replenishment of ascorbic acid developers.

7 Claims, 2 Drawing Sheets

METHOD FOR REPLENISHING AN ASCORBIC ACID DEVELOPER

FIELD OF THE INVENTION

The present invention concerns a method of replenishing and recycling an ascorbic acid developer, used for developing silver halide photographic products, in particular, when this developer has been treated by ion exchange via a selective resin in order to remove the bromide.

BACKGROUND OF THE INVENTION

When silver halide photographic products are developed with a photographic developer, the chemical composition of the developer changes over time (consumption of chemical products), necessitating the use of replenishment solutions. These replenishment solutions make it possible to maintain effective concentrations of chemical compounds in the developer.

During development, another phenomenon disturbs the composition of the developer and consequently its effectiveness. This is because, during the development of silver halide photographic products, the developer becomes enriched with halide ions coming from the photographic product. When these ions are bromide or iodide ions, they considerably slow down the image development speed.

These developers whose chemical composition has been changed through use are called "seasoned developers".

Developers initially contain a certain quantity of bromide; an additional quantity of bromide or iodide ions is released during development. It is important to maintain the bromide or iodide concentration of the developer within certain limits. Otherwise, the bromide or iodide concentration in the developer would increase continuously, which would rapidly make the developer unusable.

It is already known that the bromide or iodide ions released during development in dye coupling developers can be removed with an ion exchange resin.

EP-A-178539 describes a method for treating a seasoned developer with an anion exchanger which contains OH groups as exchangeable groups.

The article "Developer recycling—A new generation", H. Meckl, *Journal of Imaging Technology,* 13, 1987, 3, 85–89, describes a system in which the effluent at the outlet of the developing tank is poured into a holding tank. It then passes through an ion exchange resin in order to remove the bromide ions. Regenerating chemicals are added to this effluent, now devoid of bromide ions. The replenisher/regenerated solution thus obtained can be re-used as a developer.

EP-A-609940 describes a method for treating a silver halide photographic product in which the seasoned developer is treated in order to remove the seasoning ions. Then a quantity of maintenance compounds is added which is sufficiently small not to cause an overflow. The method is characterized in that the seasoned developer is treated with means which make it possible to remove in a continuous manner all the bromide ions and to maintain this zero concentration during the processing of photographic films. According to this reference, bromide ions can be removed by means of ion exchange resins. These resins are of the anionic, strongly basic type. The preferred resins being resins of the anionic type consisting of a polystyrene matrix cross-linked, for example, with divinylbenzene, comprising quaternary ammonium groups.

Also, in the noted reference, the affinity of the resins with respect to bromide, sulfite and sulfate was studied by treating a KODAK Process C-41 color developer. However, it gives no indication as to the performance of the system or the affinity of the resins which can be used.

Although these techniques for treating seasoned developers with ion exchange resins are known, it is impossible to choose from the commercially available resins an ion exchange resin which is particularly appropriate for treating a particular developer. The technical information for the different commercial resins contains only general indications of structure or a particular application. Anionic resins, cationic resins, acrylic resins, styrene resins, cross-linked or not, for example, cross-linked with divinylbenzene, do exist. These resins can be of the gel type that have a natural porosity, or of the macroporous type to which are added, when polymerization takes place, a pore-forming substance that forms an artificial porosity inside the resin.

Ion exchange resins are generally developed for the treatment of water. The diversity and concentration of ions in water are not comparable to those of the different ions present in a photographic developer.

Moreover, there are a large number of photographic developers, for example, dye coupling developers, hydroquinone developers, ascorbic acid developers, etc. These developers have complex and very different chemical compositions, and they contain a large number of ionic and organic substances in very variable quantity. The presence of organic compounds can rapidly cause poisoning of the resin, which is then ineffective in retaining ionic substances, particularly bromide ions.

It is because of this lack of selectivity of resins that it is impossible to use them to treat a black-and-white developer containing hydroquinone. In addition, the selectivity of the resins is dependent on the concentration of the different ions contained in the solution to be treated.

If these different developers are to be treated by means of anion exchange resins, the problem is to choose an effective resin from those available.

A person skilled in the art who wishes to develop a system for treating an ascorbic acid photographic developer in order to avoid the effects of seasoning has no choice but to test a large number of anion exchange resins in order to choose the most effective one.

It is indeed desirable to be able to identify in a simple and economical manner ion exchange resins which, when they are used for the treatment of a seasoned ascorbic acid developer, have improved effectiveness, that is to say a resin making it possible to treat, for a given volume, a larger volume of developer.

Certain resins have an improved effectiveness in removing bromide ions in the treatment of ascorbic acid developers, and this improved effectiveness is closely linked with the affinity of this resin for bromide ions in the presence of carbonate ions, even when the concentration of carbonate ions is much higher than the concentration of bromide ions.

SUMMARY OF THE INVENTION

It was discovered in accordance with the present invention that the treatment of the developer with an anion exchange resin did not greatly change the pH of this developer. In addition, the resin can be used whether it is in the chloride form or the hydroxyl form (OH—), the hydroxyl form being the preferred form from the point of view of photographic processing. However, the pH is an important parameter because it determines the effectiveness of the developer, that is to say the quality of the sensitometric results which can be obtained with the developer. Under these conditions, since the pH of the developer is not changed by the passage of the developer over the resin, it is not necessary to determine and control the pH in order to recycle the developer treated by the resin and/or in order to mix it with the regenerating or replenishment solution.

The invention consequently comprises a method for refreshing or maintaining an ascorbic acid photographic developer useful for the development of silver halide photographic films containing an emulsion comprising silver bromide and/or silver iodide, this method comprising treating at least part of an ascorbic acid photographic developer with an anion exchange resin having a greater affinity for bromide ions than for carbonate ions, wherein the developer is replenished jointly with a replenishment solution, the composition of which is predetermined as a function of the quantity of silver developed by the developer and the amount of the developer recycled from the anion exchange resin into the developer.

The treatment can be used at any time during the use of the developer, including and preferably from the start of its use, and before it is seasoned, particularly in the case of continuous use.

The preparation and use of these regenerating or replenishment solutions is thus simplified and, in particular, it suffices to maintain the developer by readjusting the concentration of its constituents by means of an automatic machine.

DETAILED DESCRIPTION OF THE INVENTION

Figure 1:
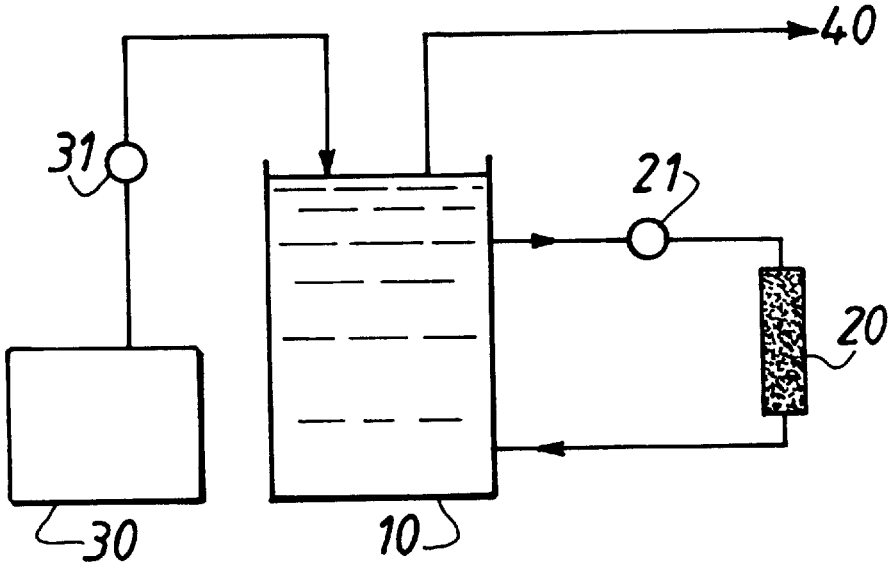
FIG. 1 is a schematic representation of a device for the continuous use of the method according to the invention.

The method of the invention makes it possible to reduce the volume of effluent and, correlatively, to reduce the COD and BOD.

In the context of the present invention, the term "ascorbic acid developer" is used to indicate a developer which contains as a main developing agent, ascorbic acid and/or a derivative thereof, for example, L-ascorbic acid, D-isoascorbic acid, D-glucoascorbic acid, 6-desoxy-L-ascorbic acid, or ascorbic acid or derivatives of ascorbic acid in the form of salt, for example, sodium ascorbate, sodium erythorbate, and others readily apparent to one skilled in the art.

These ascorbic acid developers enable the development of the silver image, transforming the exposed silver halide grains into metallic silver. They are particularly designed for the development of black-and-white photographic products, radiographic products and graphic art products. They can also be used in the black-and-white development step of a reversal process for processing color reversal materials.

Ascorbic acid developers can contain a mixture of other conventional developing agents. Conventionally, a synergetic effect is observed between the ascorbic acid and what is known as an auxiliary developing agent or "co-developer". This phenomenon, called "superadditivity" is explained in Mason *"Photographic Processing Chemistry"*, Focal Press, London, 1975.

The most frequently used co-developers include aminophenols such as Elon® (methyl-p-aminophenol sulfate), 1-phenyl-3-pyrazolidinones or phenidones, such as phenidone-A (1-phenyl-3-pyrazolidinone), phenidone-B (1-phenyl-4-methyl-3-pyrazolidinone), dimezone (1-phenyl-4,4'-dimethyl-3-pyrazolidinone), dimezone-S (1-phenyl-4-methyl-4'-hydroxymethyl-3-pyrazolidinone) and 1-phenyl-4-hydroxymethyl-4'-hydroxymethyl-3-pyrazolidinone. Additional representative examples of aminophenols and phenidones are described in U.S. Pat. No. 2,688,549, U.S. Pat. No. 2,691,589, U.S. Pat. No. 3,865,591, U.S. Pat. No. 4,269,929, U.S. Pat. No. 4,840,879 and U.S. Pat. No. 5,236,816, and in the article by G. E. Ficken and B. G. Sanderson, *The Journal of Photographic Science,* Vol 11, 1963, pages 157–164. It is also possible to use solubilized phenidones as described in FR 2,737,722.

Ascorbic acid developers can contain other chemical compounds conventionally used in photography, such as for example antioxidants, anti-fog agents, anti-liming agents and buffers.

A developer which can be used in the context of the invention is the ascorbic acid developer described in U.S. Pat. No. 5,474,879 or in *Research Disclosure,* 35249, August 1993.

In general, ascorbic acid developers contain an initial quantity of bromide which can be from about 2 to about 30 g/l. This initial quantity will increase during the processing of photographic films through the release of bromide ions contained in these films.

In general, ascorbic acid developers do not initially contain any iodide ions. These iodide ions appear in the developer only when photographic films or papers containing iodide ions are treated.

According to the invention, the developer is passed through an anion exchange resin that has a greater affinity for bromide ions than that of the carbonate ions, thus completely removing the bromide and/or iodide ions contained in the developer. At the anion exchange resin outlet, the developer thus treated contains no bromide and/or iodide ions, and the treated developer is recycled into the treatment tank.

The method of the invention can be used with the device of FIG. 1, which comprises a treatment or development tank 10 containing the ascorbic acid developer, a recirculation loop 20 equipped with a column 21 containing the anion exchange resin, which can treat the developer continuously, a replenishment unit 30 comprising a replenishment solution tank 31 and an effluent outlet 40. The device also comprises a pump 22 in the recirculation loop 20 and a pump 32 in the replenishment unit. The pumps 22 and 32 are controlled by a control unit, not depicted, which control them in accordance with the number of photographic films developed in the tank 10.

Figure 2:
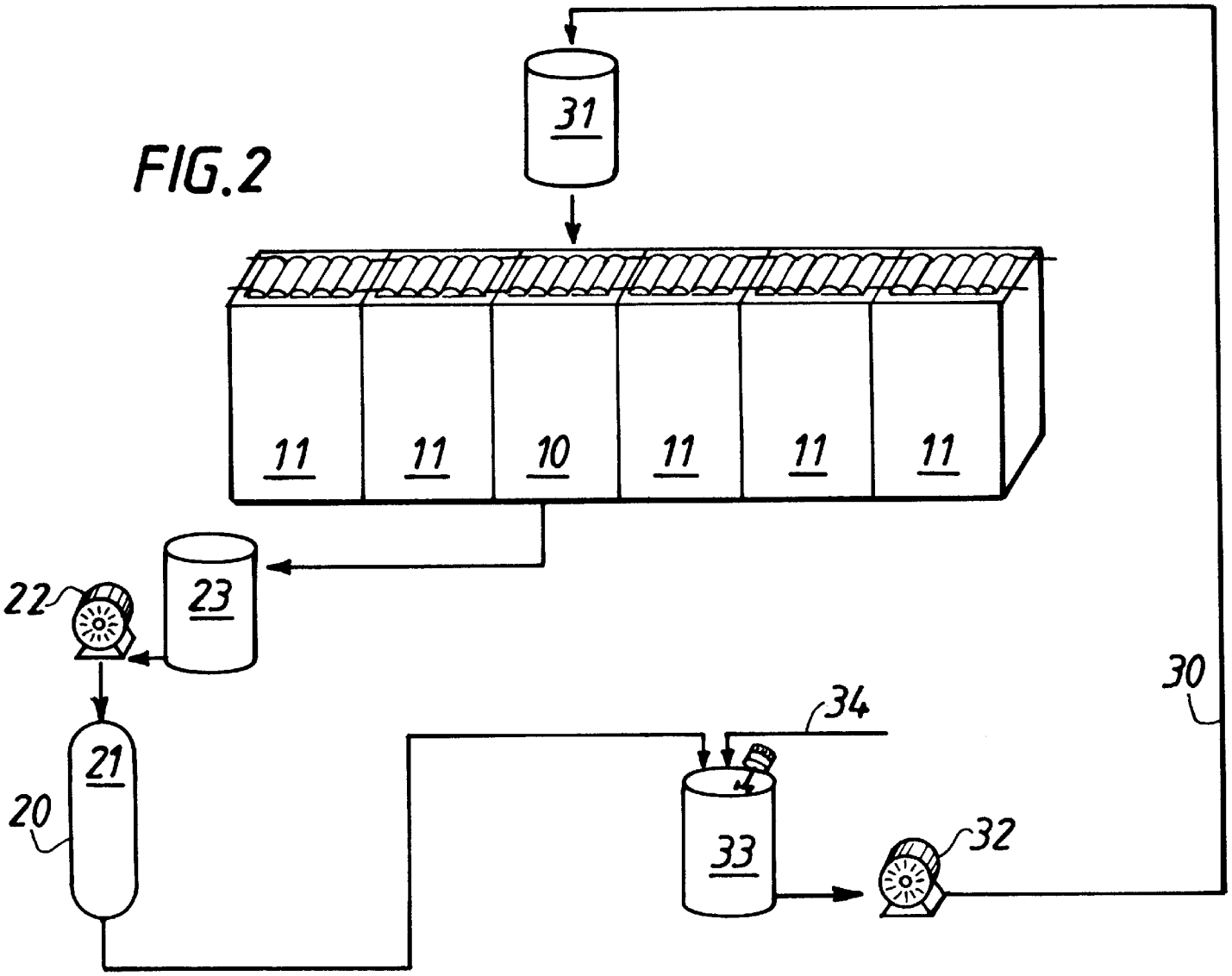
FIG. 2 is a more detailed representation of a particular embodiment shown in FIG. 1, and designed to treat color reversal products.

The device of FIG. 2 comprises a conventional assembly of processing tanks, for example, for chromogenic processing, with a development tank 10 and other tanks 11 containing other baths necessary for processing (fixing, bleaching, washing etc), a recirculation loop 20 comprising a resin column 21, a pump, and a reservoir 23 which absorbs the overflow from the tank 10 a replenishment unit 30, comprising a tank supplying replenishment solution 31, a pump 32, and a mixer 33 which receives the replenishment bath supply 34 and the solution regenerated in the recirculation loop 20.

According to a particular embodiment, the anion exchange resin having a greater affinity for bromide ions than that of carbonate ions is a strongly basic polystyrene resin of macroporous structure containing alkyl quaternary ammonium groups comprising from 1 to 4 carbon atoms.

According to particular embodiments, the anion exchange resin is chosen from the IMAC HP 555® resin, manufactured by Rohm and Haas, and the A520 E® resin, manufactured by Purolite International.

When the resin no longer satisfactorily retains the bromide and/or iodide ions, it is regenerated by means of concentrated saline solutions in order to make it re-useable for the treatment of the developer. Regeneration can be effected in the same direction as or counter to the passage of the developer. According to one particular embodiment, regeneration is effected counter to the flow by the passage of a solution of sodium chloride or of a mixture of sodium chloride and sodium hydroxide, then a sodium hydroxide solution.

Conventionally, a method for processing a black-and-white photographic product contains a silver development step, a fixing step and one or more washing steps.

In the context of the invention, the silver development step is carried out with an ascorbic acid developer.

The fixing bath makes it possible totally to transform the silver halides into water-soluble silver complexes which are then removed from the layers of the photographic product by washing. The compounds used for fixing are described in paragraph XX B of *Research Disclosure,* September 1994, No. 36544, referred to hereinafter as *Research Disclosure,* for example thiosulfates such as ammonium thiosulfate or thiosulfate of alkali metals.

The photographic product of the present invention comprises a support covered on at least one of its faces with a layer of silver halide emulsions which contains bromide and/or iodide ions in the form of silver halides. The photographic product of the invention can contain other halides, for example, chlorides, chlorobromides, bromochlorides, chloroiodides, bromoiodides or bromochloroiodides.

The silver halide emulsions consist of a hydrophilic colloid binder, in general gelatin, in which silver halide grains are dispersed.

The silver halide grains can be sensitized chemically as described in *Research Disclosure,* Section IV. They can be chromatized by spectral sensitizing dyes as described in *Research Disclosure,* Section V.

The silver halide grains can have different morphologies (see Section 1-B of *Research Disclosure*).

The photographic product can contain other photographically useful compounds, for example, coating aids, stabilizing agents, plasticizers, anti-fog agents, hardening agents, antistatic agents, matting agents etc. Examples of these compounds are described in *Research Disclosure,* Sections VI, VII, VIII, X.

The supports which can be used in photography are described in Section XV of *Research Disclosure.* These supports are in general polymer supports such as cellulose, polystyrene, polyamide and polyvinyl polymers, polyethylene, polyester, paper or metal supports.

The photographic products can contain other layers, for example, a protective top layer, intermediate layers, an antihalation layer, an antistatic layer, etc. These different layers and their arrangements are described in Section XI of *Research Disclosure.*

According to one embodiment of the invention, the photographic products which are processed are radiographic products that comprise a support having on each of its surfaces a silver halide emulsion layer and a protective overcoat layer. The emulsions are generally emulsions containing essentially silver bromide.

The present invention is illustrated by the following examples.

EXAMPLE 1

Seasoning of the bath

In the following examples, T-MAT G/RA® radiographic films manufactured by EASTMAN KODAK® were used. These products were exposed directly to X-rays so as to obtain, after developing, an average density of 1.2. Development was effected in a KODAK X-OMAT 480 RA treatment machine using the developer described above (25 sec., 35° C.), followed by a fixing step (20 sec., 35° C.), a washing step (15 sec., 20° C.) and a drying step (25 sec., 55° C.).

| Initial composition of the ascorbic acid developer | |
|---|---|
| Ascorbic acid | 32 g/l |
| 4-hydroxymethyl-4-methyl-1-phenyl-3-pyrazolidinone | 2.5 g/l |
| Benzotriazole | 0.2 g/l |
| $K_2CO_3$ | 100 g/l |
| $K_2SO_3$ | 50 g/l |
| Diethylenetriamine-pentacetic acid (sol. 40%) | 4.3 g/l |
| KBr | 4 g/l |

Replenishing the developer

The composition of the replenishing bath was determined as follows. The standard replenishing rate was 60 ml per sheet treated, and a recirculation rate of 50% was provided for, that is to say for 60 ml/sheet, 30 ml came from recirculation and 30 ml came from replenishment. For an average density of 1.2 and a recirculation of 10 liters of developer per liter of resin, the quantity of salted-out bromide and the quantity of organic constituents retained (and thus to be replaced) was determined. Under these conditions, the composition of the refreshing bath was as follows:

| | |
|---|---|
| Ascorbic acid | 32.0 g/l |
| 4-hydroxymethyl-4-methyl-1-phenyl-3-pyrazolidinone | 4.0 g/l |
| Benzotriazole | 0.4 g/l |
| $K_2CO_3$ | 100.0 g/l |
| $K_2SO_3$ | 55.0 g/l |
| Diethylenetriamine-pentacetic acid (sol. 40%) | 4.3 g/l |
| pH | 10.3 |

This replenisher bath was used in a device as depicted in FIG. 1.

Four hundred plates of exposed T-MAT G/RA® films (60 $m^2$) were processed according to the preceding method continuously with the ascorbic acid developer described above. The developer was thus enriched with the bromide ions from the developed films.

Treatment of the developer

Overflow from the developer tank (developer enriched with bromide) was treated via an anion exchange resin 21 in order to remove the bromide ions. For this purpose, the developer was passed through a column containing 0.6 liter of anion exchange resin. The resin used was IMAC HP 555® (Rohm & Haas).

The sensitometric results obtained with a freshly prepared developer were compared with a developer maintained by replenishment and recycling according to the invention.

TABLE 1

| | Dmin | Dmax | Sensitivity | Contrast | LSC | USC |
|---|---|---|---|---|---|---|
| Fresh developer | 0.22 | 3.83 | 444.2 | 3.04 | 2.11 | 3.05 |
| Seasoned and refreshed developer | 0.22 | 3.75 | 440.6 | 3.08 | 2.07 | 3.02 |

These results show that the sensitometric characteristics were only very slightly affected and within limits which remain acceptable and were not significantly different from those obtained during standard seasoning without recycling of the developer.

In addition, the replenishment rate supply had been divided by 2 (30 ml instead of 60 ml per sheet). This is because, as soon as use of the developer begins, part of it is being recycled by being passed over the resin, which prevents the increase in the Br—concentration and thus makes it possible to reduce the necessary replenishment rate. The recycling rate of 50% did not cause an increase in the bromide level. No adjustment of the pH of the treated solution was necessary. In addition, the developer thus regenerated and reconstituted can be used to develop all the films for which it is normally provided.

Sensitivity: exposure in order to produce a density of 1.00 above the density of support plus fog;

Contrast: slope of the characteristic curve between densities 2.00 and 0.25 above the density of support plus fog;

LSC: slope of the characteristic curve between a density and 0.85 above the density of support plus fog and −0.03 log E;

USC: slope of the characteristic curve between the densities 2.85 and 1.50 above density of support plus fog.

The invention has been described in detail with particular reference to certain preferred embodiments thereof, but it will be understood that variations and modifications can be effected within the spirit and scope of the invention.

I claim:

1. A method of recycling or replenishing an ascorbic acid photographic developer useful for the development of silver halide photographic films containing an emulsion comprising silver bromide and/or silver iodide, said method comprising treating at least part of an ascorbic acid photographic developer with an anion exchange resin having a greater affinity for bromide ions than for carbonate ions, wherein said developer is also reconstituted with a modified replenishment solution, the composition of which is predetermined as a function of the quantity of silver developed by said developer and the amount of said developer recycled from said anion exchange resin into said developer.

2. The method of claim 1 wherein the ascorbic acid developer essentially contains bromide ions.

3. The method of claim 1 wherein the ascorbic acid developer contains bromide ions and iodide ions.

4. The method of claim 3 wherein the quantity of bromide ions is greater than the quantity of iodide ions.

5. The method of claim 1 wherein the anion exchange resin is a resin of the macroporous type, with a matrix comprising a cross-linked polystyrene, containing alkyl ammonium alkyl groups having 1 to 4 carbon atoms.

6. The method of claim 1 wherein the recycling is provided continuously by means of a recirculation loop comprising the said ion exchange resin and a pump.

7. The method of claim 6 wherein the modified replenishing solution is supplied from a reservoir using a pump, this pump and that of the recirculation loop, being controlled by a control unit which controls both the modified replenishing solution and the recirculation loop pump.

* * * * *